US008328307B2

(12) United States Patent
VanKouwenberg et al.

(10) Patent No.: US 8,328,307 B2
(45) Date of Patent: Dec. 11, 2012

(54) IMAGING DEVICE CONFIGURED TO REMOVE RESIDUAL MARKING MATERIAL FROM AN INTERMEDIATE IMAGING MEMBER

(75) Inventors: David Alan VanKouwenberg, Avon, NY (US); Paul McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 155 days.

(21) Appl. No.: 12/891,180

(22) Filed: Sep. 27, 2010

(65) Prior Publication Data

US 2012/0075367 A1 Mar. 29, 2012

(51) Int. Cl.
*B41J 29/38* (2006.01)
*B41J 2/01* (2006.01)

(52) U.S. Cl. ..... 347/9; 347/103
(58) Field of Classification Search ..... None
See application file for complete search history.

(56) References Cited

U.S. PATENT DOCUMENTS

| | | | | |
|---|---|---|---|---|
| 6,785,491 | B2 | 8/2004 | Mitsu et al. | |
| 7,733,530 | B2 | 6/2010 | Ryan, Jr. et al. | |
| 2004/0021839 | A1 | 2/2004 | Kato | |
| 2005/0100378 | A1 | 5/2005 | Kimura et al. | |
| 2009/0027436 | A1 * | 1/2009 | McConville et al. | 347/16 |
| 2010/0020146 | A1 | 1/2010 | Gervasi et al. | |

* cited by examiner

*Primary Examiner* — Geoffrey Mruk
(74) *Attorney, Agent, or Firm* — Maginot, Moore & Beck, LLP

(57) ABSTRACT

A method of operating an inkjet imaging device more thoroughly cleans residual ink from an intermediate imaging member and disrupts any ghosted images that may have formed in the release agent.

10 Claims, 2 Drawing Sheets

IMAGING DEVICE CONFIGURED TO REMOVE RESIDUAL MARKING MATERIAL FROM AN INTERMEDIATE IMAGING MEMBER

TECHNICAL FIELD

The present disclosure relates generally to inkjet imaging devices and, more particularly, to inkjet imaging devices having an intermediate imaging member.

BACKGROUND

Commercial and consumer imaging devices, such as printers, plotters, and facsimile machines, may employ drop on demand inkjet technology for producing printed media. These imaging devices form an inkjet image by selectively ejecting ink drops onto an image substrate from a plurality of drop generators or inkjets arranged in a printhead or a printhead assembly. The ink may be directly ejected onto an image receiving media and then fixed to the media or the ink may be ejected onto an intermediate imaging member. The ink is subsequently transferred to image receiving media and then fixed to the media. A printhead controller generates firing signals that are delivered to the inkjet ejectors in a printhead to activate the inkjet ejectors selectively. The inkjets eject ink in response to the firing signals. The inkjets may eject liquid inks including, but not limited to, aqueous, solvent, oil based, liquefied solid ink, and curable ink.

A solid ink imaging device having an intermediate imaging member typically includes a drum maintenance unit ("DMU"). Previously known DMUs include an applicator, a wiper, and a reservoir for holding a release agent. Capillary forces deliver the release agent to the applicator, which applies the release agent to the surface of the intermediate imaging member. The wiper meters and smoothes the release agent on the surface of the intermediate imaging member. Once ejected, the ink coalesces on the layer of release agent on the intermediate imaging member. When the ink image and media pass through a nip formed between the intermediate imaging member and a transfer member, the ink image transfers from the intermediate imaging member to the media. In particular, the layer of release agent on the intermediate transfer member facilitates this transfer. After the image is transferred, the intermediate imaging member rotates to the DMU where more release agent is applied to the member and metered. The reapplication of release agent and the metering action of the wiper help lubricate the image receiving area of the intermediate imaging member as well as remove most excess oil, ink, and other debris that may have rested on the surface of the intermediate imaging member. In some cases, however, the tackiness of the coalesced ink may cause a portion of the ink, referred to herein as residual ink, to remain on the intermediate imaging member. During the next print job, some or all of the residual ink may transfer to a subsequent print medium and generate a latent version of the inkjet image. Also, a "ghosted" image may be present in the release agent remaining on the intermediate imaging member. The ghosted image may form a gloss defect in subsequent prints.

Generally, the typical DMU cycle sufficiently prepares the image receiving area of the intermediate imaging member for most print jobs. Some users are concerned about residual ink and/or ghosted images being transferred to subsequent media, especially when the content of an ink image is confidential or the like. Consequently, a continuing need remains in the art to develop methods and imaging devices configured to remove residual ink from the image receiving area of an intermediate imaging member more thoroughly, and also to disrupt any ghosted images in the release agent remaining on the intermediate imaging member subsequent to ink transfer.

SUMMARY

A method of operating an inkjet imaging device more thoroughly cleans residual ink from an intermediate imaging member and disrupts any ghosted images that may have formed in the release agent. The method of operating an inkjet imaging device includes ejecting ink from a printhead into a document zone on a transfer member as the document zone on the transfer member moves past the printhead, moving a transfix member against the transfer member to form a nip, transferring the ejected ink to an image receiving medium as the document zone on the transfer member and the image receiving medium pass through the nip, applying release agent to the document zone on the transfer member subsequent to the transfer of the ejected ink, and moving the document zone on the transfer member (i) through the nip without passing an image receiving medium through the nip and (ii) past the printhead without operating the printhead to eject ink in response to a controller detecting a first condition.

An inkjet imaging device implementing the method more thoroughly cleans residual ink from an intermediate imaging member and disrupts any ghosted images that may have formed in the release agent. The inkjet imaging device includes a transfer member, a transfix member configured to move against the transfer member to form a nip, a printhead configured to eject ink into a document zone of the transfer member as the document zone on the transfer member moves past the printhead, the transfer member transferring the ejected ink to an image receiving medium as the document zone on the transfer member and the image receiving medium pass through the nip, an applicator configured to apply release agent to the document zone on the transfer member subsequent to transfer of the ejected ink, and a controller configured to detect a first condition and in response to detecting the first condition the controller being further configured to move the document zone on the transfer member through the nip without passing an image receiving medium through the nip and past the printhead without operating the printhead to eject ink.

DETAILED DESCRIPTION

Reference is made to the figures for a general understanding of the environment and the details for the device and method disclosed herein. As used herein, the terms "printer" and "imaging device," which may be used interchangeably, encompass any device that performs a print outputting function for any purpose, such as a digital copier, bookmaking machine, facsimile machine, a multi-function machine, etc. The terms "image receiving medium/media" and "print medium/media" each refer to a physical sheet/sheets of paper, plastic, or other suitable substrate for receiving an image. The print media may be cut sheets of print media or a substantially continuous web of print media. The term "print job" refers to a set of related images to be printed on the print media, one or more collated copy sets copied from a set of original print job sheets, or electronic document page images from a particular user. An "image," as the term is used herein, may include information in electronic form, which the imaging device renders on the print media. An image may include text, graphics, pictures, and the like. The operation of applying images to print media is generally referred to herein as "printing" or "marking."

Figure 1:
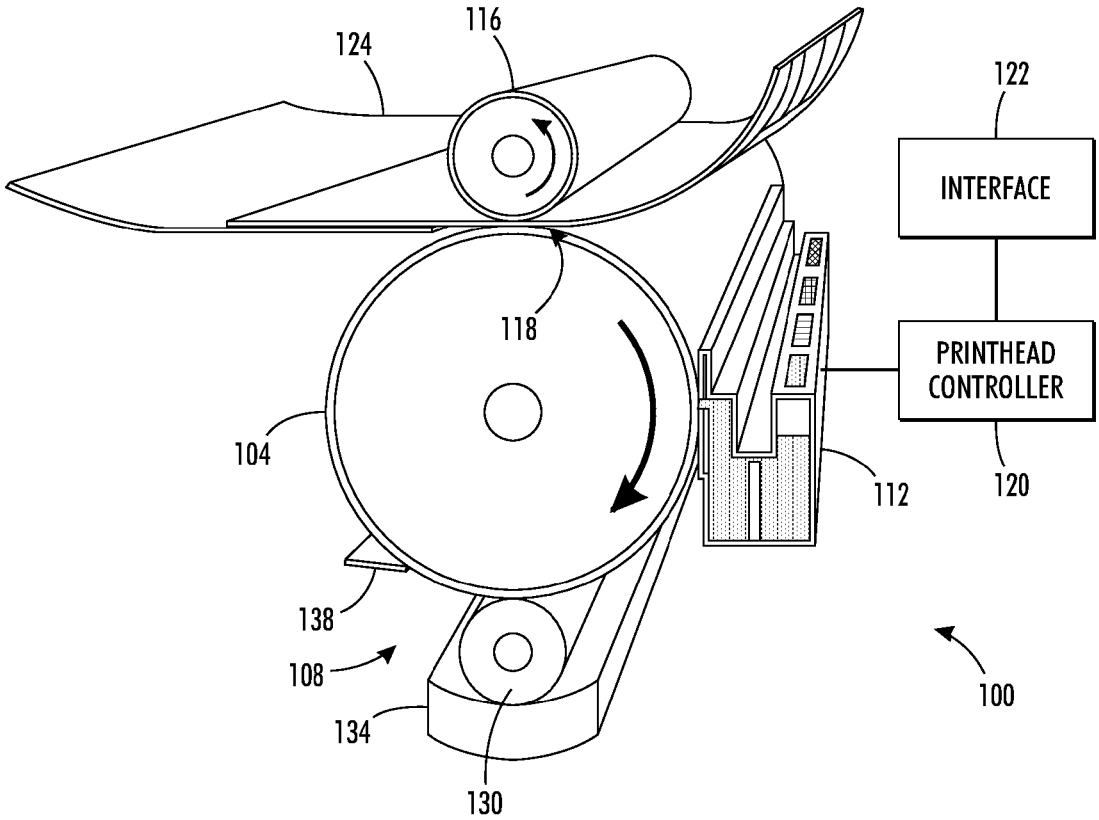
FIG. 1 illustrates a portion of an imaging device having an intermediate imaging member and an assembly configured to remove residual ink from an imaging area of the intermediate imaging member and also to disrupt any ghosted images that may have formed in the release agent on the imaging area of the intermediate imaging member.

As shown in FIG. 1, a portion of an inkjet imaging device 100 includes an imaging drum 104, a drum maintenance unit 108, a printhead 112, a transfix roller 116, a printhead controller 120, and an interface 122. A frame (not shown) of the imaging device 100 positions the printhead 112 to eject ink onto the imaging drum 104. The drum maintenance unit 108 prepares the imaging drum 104 to receive ink from the printhead 112 and to transfer the ink to a print medium 124. The printhead controller 120 controls movement of the transfix roller 116 against the imaging drum 104 to form a nip 118. The controller 120 also controls rotation of the imaging drum 104 such that a print medium 124 and a document zone on the imaging drum 104 enter the nip 118 in a manner suitable to transfer the ink ejected in the document zone to the print medium. The imaging device 100 may print an image on only a first side of the print medium 124, a process referred to as a simplex printing or a simplex print mode. Alternatively, the imagining device 100 may include an inversion system (not shown) configured to enable the imaging device to print images on both sides the print medium 124, a process referred to as a duplex printing or a duplex print mode.

The imaging device 100 enables a user to select a "clean print mode," also referred to as a "clean printing mode" and a "clean mode," in which the controller 120 operates the device 100 to remove residual ink from the document zone of the imaging drum 104. This operation helps reduce the likelihood of a latent image forming upon another section or sheet of print media. A "latent image" refers to an image printed on a print medium with residual ink on the imaging drum 104 from an ink image previously transferred to another print medium. When operating in the clean mode the imaging device 100 also disrupts any "ghosted" images that may have formed on the document zone of the imaging drum 104 subsequent to the transfer of ink to the print media. A "ghosted image" refers to an image from a previous print, which may appear as a gloss defect in a subsequent print or prints. Accordingly, some users may find the clean mode useful to print an image, document, or print job containing sensitive content. The term "sensitive content," as used herein, refers to content that a user considers confidential, privileged, private, or that the user otherwise intends for limited or exclusive distribution. Exemplary sensitive content includes but is not limited to, social security numbers and electronic banking data. The clean mode may also be referred to herein as a "sensitive content printing mode," a "secure mode," or a "secure print mode."

The printhead 112 of the imaging device 100 includes an ink reservoir, inkjet ejectors, and nozzles as known to those of ordinary skill in the art, but not illustrated in FIG. 1. The nozzles are fluidly connected to the ink reservoir to receive liquid ink from the ink reservoir. The inkjet ejectors receive firing signals from the controller 120 in a known manner and, in response, eject ink droplets in the document zone of the imaging drum 104. As used in this document, "document zone" refers to a surface area on an intermediate imaging member in which ink images are formed by operation of one or more printheads. An intermediate imaging member may have one or more document zones. The inkjet ejectors in a printhead may be thermal inkjet ejectors, piezoelectric inkjet ejectors, or any other inkjet ejector known to those of ordinary skill in the art. Although FIG. 1 depicts only one printhead 112, the imaging device 100 may include numerous printheads positioned about imaging drum 104.

The imaging drum 104, which may be referred to as an intermediate imaging member or a transfer member, receives ink from the printhead 112 and transfers the ink to the print medium 124. An electrical motor (not shown) rotates the imaging drum 104 to enable the printhead to form an ink image on the imaging drum in the direction of drum rotation, which is also known as the process direction. Other types of intermediate imaging members may include an rotating endless belt or an imaging plate.

As noted above, the imaging drum 104 includes a document zone. Depending on the size of the media to which an ink image is transferred, the document zone may include all or a portion of the outer surface of the imaging drum 104. The controller 120 coordinates the rotation of the imaging drum to present the document zone to the printhead(s) for formation of the ink image within the document zone and then synchronizes the formation of the nip between the imaging drum and the transfix roller 116 along with the mutual arrival of the ink image and the print medium at the nip to ensure that the ink image is correctly transferred from the imaging drum 104 to an appropriate area within the margins of the medium.

The transfix roller 116, which is a type of transfix member, assists in transferring the ink ejected in the document zone of the imaging drum 104 to the media 124. The term transfix member, as used herein, refers to any member that presses the media 124 against an intermediate imaging member to press the print media against the imaging member and facilitate the transfer of the ink image to the media. As shown in FIG. 1, the transfix member is a transfix roller 116 connected to a positioning system (not shown). The positioning system, as controlled by the controller 120, moves the transfix roller 116 into and out of contact with the imaging drum 104. The positioning system may bias the transfix roller 116 against the imaging drum 104 with a suitable pressure for the type of ink and media being used.

The controller 120 forms a nip 118 by moving the transfix roller 116 against the imaging drum 104. The nip 118 refers to a contact point between the transfix roller 116 and the imaging drum 104. The rotation of the imaging drum 104 propels print media that contacts the nip 118 through the nip. When the controller 120 forms the nip 118 the rotation of the imaging drum 104 may slow because some rotational energy of the imaging drum is transferred to the transfix roller 116. Accordingly, the controller 120 may signal to the positioning system to move the transfix roller 116 away from the imaging drum 104 to enable an increase in the rotational speed of the imaging drum 104 after the ink image transfer is complete. In one embodiment, the controller 120 may form the nip 118 only when the document zone is in a position to contact the transfix roller 116.

To facilitate further the transfer of the ink ejected in the document zone to the print medium 124, the imaging device 100 includes a drum maintenance system 108, also referred to as a drum maintenance unit ("DMU"). During a typical DMU cycle the DMU 108 applies release agent to the document zone of the imaging drum 104 to prepare the document zone for the ejection of ink from the printhead 112. The release agent provides a surface on which the printhead 112 ejects the ink and prevents the ink from adhering to the imaging drum 104. Typical release agents include silicone oil and the like.

As depicted in FIG. 1, the DMU 108 includes an applicator 130, a receptacle 134, and a wiper 138. The controller 120 activates a DMU positioning unit (not shown) to move the applicator 130 and the wiper 138 relative to the imaging drum 104. As shown in FIG. 1, the controller 120 has moved the applicator 130 and wiper 138 against the imaging drum 104 to enable the DMU 108 to apply release agent to the imaging drum 104. The controller 120 moves the applicator 130 and the wiper 138 away from the imaging drum 104 to enable ink ejected in the document zone to pass the DMU 108 without interference. The applicator 130 refers to any device configured to apply release agent to the document zone, such a roller. Accordingly, the applicator 130 may be an absorbent material, such as extruded polyurethane foam, which has an oil retention capacity and a capillary height that enables the applicator to retain release agent even when fully saturated with release agent. To facilitate saturation of the applicator 130 with the release agent, the applicator is positioned over the reclaim receptacle 134, which is generally provided as a tub or trough. The wiper 138, also referred to as a wiping member, contacts the imaging drum 104 in response to the applicator 130 contacting the drum in order to remove excess release agent and to prepare the remaining release agent in the document zone to receive ink from the printhead 112. The wiper 138 and the applicator 130 each have a length at least equal to a width of the document zone as measured in a direction parallel to the axis of rotation of the imaging drum 104.

In a typical inkjet imaging device, the applicator 130 and wiper 138 are moved away from the imaging drum 104 to enable the rotational speed of the drum to be increased. The prepared document zone then passes by the transfix roller 116, which is positioned away from the drum 104 so that the nip 118 is not formed, and then arrives at a position opposite the printhead 112. After an ink image is formed in the document zone, the document zone passes the DMU 108, which remains in the disengaged position, and, as the document zone approaches the transfix roller 116, the printhead controller 120 moves the transfix roller into engagement with the imaging drum 104 to form the nip 118. After the ink image is transferred to the print medium, the transfix roller 116 is disengaged from the imaging drum 104 and the document zone rotates past the printhead 112 to be prepared by the DMU 108 for the next print cycle.

The interface 122 is configured to receive a user input configured to switch the imaging device 100 between a "normal" print mode and a "clean" print mode. As shown in FIG. 1, electrical circuits connect the interface 122 to the controller 120. The term interface 122 includes any device configured to enable a user to select a print mode. An exemplary interface 122, includes, but is not limited to, a user-positionable actuator, a switch, a touch screen, and/or a voice-activated unit. The interface 122 generates a clean print signal, also referred to as a secure print signal, which is coupled to the controller 120. The clean print signal instructs the controller 120 to cause the device 100 to enter the clean print mode.

The printhead controller 120 is electrically connected to the printhead 112, the interface 122, the DMU 108, the positioning device of the transfix roller 116, and the electrical motor configured to rotate the imaging drum 104. The controller 120 is configured to control operation of each component to which it is connected. The controller 120 detects the state of the device 100 for conditions including, but not limited to, the normal print mode/signal, the secure print mode/signal, simplex print mode/signal, and duplex print mode/signal. The controller 120 includes electronic memory to store data and programmed instructions, which may be executed with general or specialized programmable processors. The programmed instructions, memories, and interface circuitry configure the controller 120 to generate firing signals in relation to an angular velocity of the imaging drum 104. The components of the controller 112 may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Figure 2:
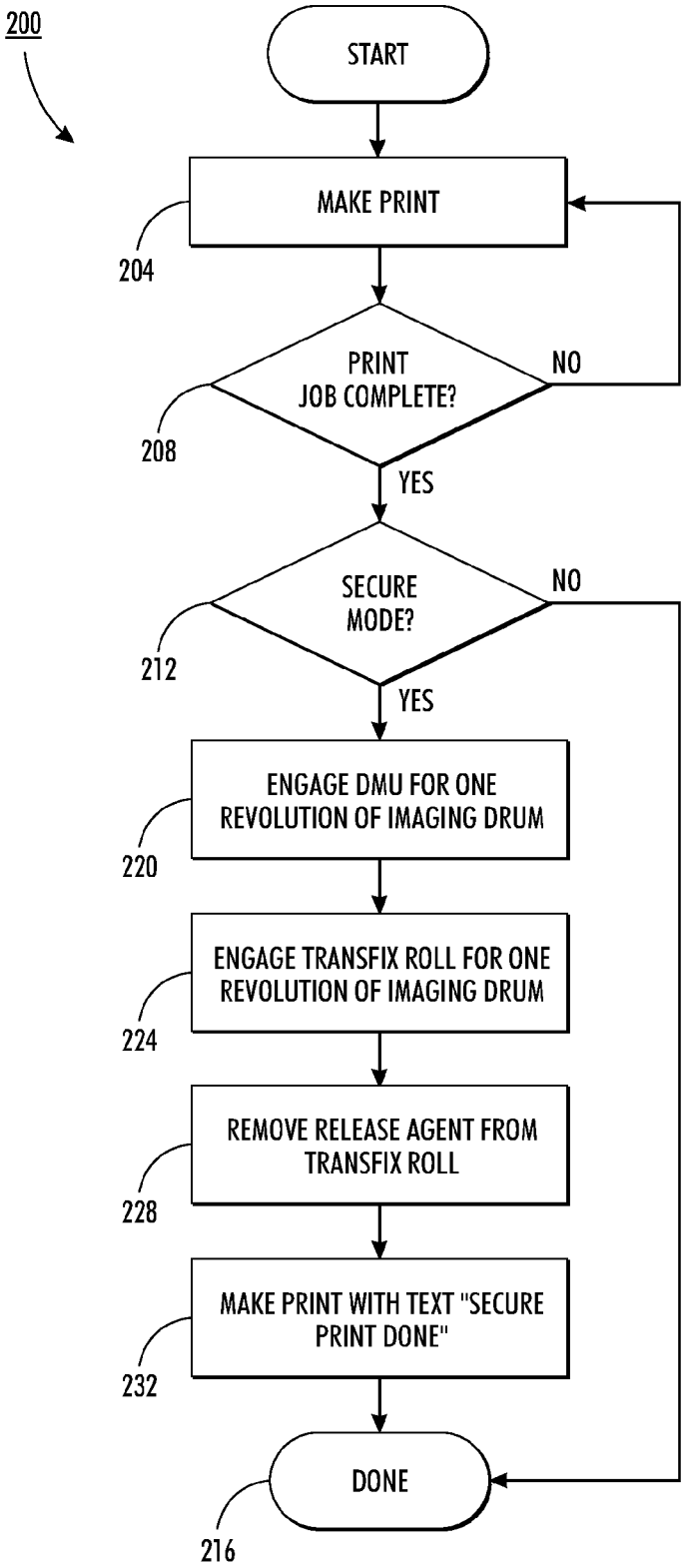
FIG. 2 illustrates a flowchart depicting a method of operating the imaging device of FIG. 1.

In operation, the imaging device 100 implements a method 200, as shown in FIG. 2, to facilitate the dispersion and the removal of residual ink and ghosted images from the imaging drum 104 and the transfix roller 116 in response to the printhead controller 120 detecting a secure mode signal (also referred to as a clean print signal). Accordingly, the method 200 prevents the formation of a latent image(s) during subsequent print jobs. First, a user of the imaging device 100 selects a normal print mode or a secure print mode and sends a print job to the device. In general, the user selects the normal print mode for print jobs without sensitive content and selects the secure print mode for print jobs having sensitive content or for any print job in which the user desires a high level of latent image prevention.

Next, the device 100 prepares the imaging drum 104 to receive ink and prints the image(s) associated with the print job onto the print medium/media (block 204). The preparation and printing process is the same for both the normal print mode and the secure print mode. To prepare the imaging drum 104 to receive ink, the controller 120 causes the applicator 130 and the wiper 138 of the DMU 108 to move against the imaging drum 104 and then rotates the document zone past the DMU such that the document zone receives a thin and consistent coating of release agent. This process is referred to as engaging the DMU 108 with the imaging drum 104. Subsequently, the controller 120 moves the applicator 130 and the wiper 138 away from the imaging drum 104, such that the document zone rotates without contacting any printing element in a process referred to as disengaging the DMU 108. Next or concurrently, the controller 120 processes digital data of the image(s) associated with the print job and generates a sequence of firing signals. Thereafter, the printhead 112 receives the firing signals and ejects ink onto the release agent applied to the document zone to form an ink image in the document zone. The document zone may pass the printhead 112 one or more times to receive ink in a manner suitable to form the ink image, with the DMU 108 disengaged. To print the image formed on the document zone, the controller 120 moves the transfix roller 116 into contact with a portion of the imaging drum 104 dissociated with the document zone, which causes the transfix roller to begin to rotate with the imaging drum. Next, the controller 120 operates a media transport to insert the print medium 124 into the nip 118 as the document zone approaches the nip. The medium 124 moves through the nip 118 and receives the ink from the document zone in a process referred to as ink transfer. After the document zone passes through the nip 118, the controller 120 may move the transfix roller 116 away from the imaging drum 104 to eliminate the nip. The device 100 continues to prepare the imaging drum 104 and to transfer ink to print medium until each image associated with the print job has been printed on the print medium/media (block 208).

Next, the controller 120 determines if the user selected the normal print mode or the secure print mode (block 212). If the normal print mode is active, subsequent to printing the image (s), the device 100 waits until the controller 120 receives the next print job and then performs the method 200 again (block 216). To this end, the device 100 may enter a power save mode or other such reduced energy state subsequent to the completing the print job. If, however, the controller 120 detects the secure print mode signal, the controller 120 performs additional actions (blocks 220-232) to reduce the possibility that the device 100 may print a latent image during the next print job.

If the controller 120 detects the secure print mode (block 212), the controller 120 engages the DMU 108 for at least one revolution of the imaging drum 104 with the transfix roller 116 separated from the imaging drum (block 220). Specifically, after the document zone exits the nip 118 following the last ink transfer of the print job, the transfix roller 116 is moved away from the imaging drum, the document zone passes the printhead 112 without receiving ink, and then the document zone moves past the DMU 108, which is in the engaged position. During this DMU cycle, the DMU 108 applies and meters release agent to the entire surface of the imaging drum 104 including the document zone and surface portions that may not have received ink during the ink ejection process the imaging drum. Additionally, during this DMU cycle, the DMU 108 removes much of the ink and other debris remaining on the surface of the imaging drum 104 subsequent to the ink transfer. The controller 120 disengages the DMU 108 subsequent to the one revolution of the imaging drum 104.

Next, the controller 120 moves the transfix roller 116 against the imaging drum 104 to form the nip 118 for at least one revolution of the imaging drum 104 (block 224). Therefore, the entire surface of the imaging drum 104 (including the document zone) moves through the nip 118 without the presence of a print medium (block 224). The pressure imparted upon the surface of the imaging drum 104 by the nip 118 disperses any residual ink remaining on the imaging drum into the release agent, such that the ink takes a form that is different from the image(s) previously transferred to the print medium. After the at least one revolution of the imaging drum 104, the controller 120 moves the transfix roller 116 away from the imaging drum 104 and then engages DMU 108 with the imaging drum 104 to remove the residual ink dispersed within the release agent. The imaging drum 104 may be rotated one or more times during this DMU cycle, after which the document zone is free from any residual ink and does not form a latent image should a print medium be placed in contact with the document zone.

During the ink dispersal process (block 220) the imaging drum 104 may transfer some of the release agent and the dispersed residual ink to the surface of the transfix roller 116. For this reason, the controller 120 causes the device 100 to perform a blank print cycle to remove any release agent and dispersed residual ink from the transfix roller 116 (block 228). To perform a blank print cycle the controller 120 operates the media transport to insert the print medium 124 into the nip 118. The print medium receives the release agent and dispersed residual ink on the surface of at least a portion of the transfix roller 116. In particular, if the length of the print medium in the process direction is longer than the circumferential length of the transfix roller 116, then the print medium removes the release agent and the dispersed residual ink from the entire surface of the transfix roller. If, however, the length of the print medium in the process direction is less than the circumferential length of the transfix roller 116, then the print medium only removes the release agent and dispersed residual ink from a portion of the surface of the transfix roller. In such a situation, the controller 120 operates the media transport to insert another print medium 124 into the nip to remove the release agent and dispersed residual ink from the remaining portion of the surface of the transfix roller. The dispersed residual ink transferred to the print medium from the transfix roller does not form a latent image on the print medium/media because the nip 118 has dispersed the residual ink into a form different from the image(s) previously transferred to the print medium. Nonetheless, even though this process is referred to as a "blank print cycle" the print medium/media may exit the device 100 having ink thereon. The controller 120 performs the blank print cycle after completing both simplex and duplex print jobs. In another embodiment, however, the controller 120 performs the blank print cycle only after completing a duplex print job.

The device 100 may print the text "Secure Print Done," or the like, on one or more of the print media used during the blank print cycle. The printed upon print medium/media is a positive indication to the user that the device has completed the secure print cycle successfully. Alternatively, the device 100 may collect the print medium/media used during the blank print cycle in an internal collection receptacle and display the text "Secure Print Done," or the like, on the interface. Thereafter, the controller 120 may prepare the imaging drum 104 for the next print job.

The imaging device 100 prints images with one of numerous ink compositions. Exemplary ink compositions include, but are not limited to, phase change inks, gel based inks, curable inks, aqueous inks, and solvent inks. As used herein, the term "ink composition" encompasses all colors of a particular ink composition including, but not limited to, usable color sets of an ink composition. For example, an ink composition may refer to a usable color set of phase change ink that includes cyan, magenta, yellow, and black inks. Therefore, as defined herein, cyan phase change ink and magenta phase change ink are different ink colors of the same ink composition.

The term "phase change ink," also referred to as "solid ink," encompasses inks that remain in a solid phase at an ambient temperature and that melt to a liquid phase when heated above a threshold temperature, referred to in some instances as a melt temperature. The ambient temperature is the temperature of the air surrounding the imaging device 100; however, the ambient temperature may be a room temperature when the imaging device 100 is positioned in an enclosed or otherwise defined space. An exemplary range of melt temperatures for phase change ink is approximately seventy degrees (70°) to one hundred forty degrees (140°) Celsius; however, the melt temperature of some phase change inks may be above or below the exemplary melt temperature range. When phase change ink cools below the melt temperature the ink returns to the solid phase.

The terms "gel ink" and "gel based ink," as used herein, encompass inks that remain in a gelatinous state at the ambient temperature and that may be heated or otherwise altered to have a different viscosity suitable for ejection by the printhead 112. Gel ink in the gelatinous state may have a viscosity between $10^5$ and $10^7$ centipoise ("cP"); however, the viscosity of gel ink may be reduced to a liquid-like viscosity by heating the ink above a threshold temperature, referred to as a gelation temperature. An exemplary range of gelation temperatures is approximately thirty degrees (30°) to fifty (50°) degrees Celsius; however, the gelation temperature of some gel inks may be above or below the exemplary gelation temperature range. The viscosity of gel ink increases when the ink cools below the gelation temperature.

Some ink compositions, referred to herein as curable inks, are cured by the imaging device 100. As used herein, the process of "curing" ink refers to curable compounds in an ink undergoing an increase in molecular weight in response to being exposed to radiation. Exemplary processes for increasing the molecular weight of a curable compound include, but are not limited to, crosslinking and chain lengthening. Cured ink is suitable for document distribution, is resistant to smudging, and may be handled by a user. Radiation suitable to cure ink may encompass the full frequency (or wavelength) spectrum including, but not limited to, microwaves, infrared, visible, ultraviolet, and x-rays. In particular, ultraviolet-curable gel ink, referred to herein as UV gel ink, becomes cured after being exposed to ultraviolet radiation. As used herein, the term "ultraviolet" radiation encompasses radiation having a wavelength from approximately fifty nanometers (50 nm) to approximately five hundred nanometers (500 nm).

It will be appreciated that some or all of the above-disclosed features and other features and functions or alternatives thereof, may be desirably combined into many other different systems, apparatus, devices, or applications. Various presently unforeseen or unanticipated alternatives, modifications, variations, or improvements therein may be subsequently made by those skilled in the art, which are also intended to be encompassed by the following claims.

What is claimed is:

1. A method of operating an inkjet imaging device comprising:

ejecting ink from a printhead into a document zone on a transfer member as the document zone on the transfer member moves past the printhead;

moving a transfix member against the transfer member to form a nip;

transferring the ejected ink to an image receiving medium as the document zone on the transfer member and the image receiving medium pass through the nip;

altering operation of the inkjet imaging device in detection of a predetermined mode of operation of the inkjet imaging device, the operation alteration including:

moving the transfix member out of engagement with the transfer member;

applying release agent to the transfer member for at least one revolution after the transfix member moves out of engagement with the transfer member;

moving the transfix member into engagement with the transfer member to form the nip for at least one more revolution after the at least one revolution; and moving at least one image receiving medium through the nip to transfer ink dispersed by the transfix member onto the image receiving medium.

2. The method of claim 1, the first predetermined mode of operation being a secure mode of operation.

3. The method of claim 2 further comprising:

generating a secure mode signal with an interface to commence the secure mode of operation for the inkjet imaging device.

4. The method of claim 1 further comprising:

moving a wiping member into engagement with the transfer member to wipe release agent from the transfer member during the at least one revolution in which release agent is applied.

5. The method of claim 4, further comprising:

moving the wiping member out of engagement with the transfer member before moving the transfix member into engagement with the transfer member for the at least one more revolution.

6. An inkjet imaging device comprising:

a transfer member;

a transfix member configured to move against the transfer member to form a nip;

a printhead configured to eject ink into a document zone of the transfer member as the document zone on the transfer member moves past the printhead, the transfer member transferring the ejected ink to an image receiving medium as the document zone on the transfer member and the image receiving medium pass through the nip;

an applicator configured to apply release agent to the document zone on the transfer member subsequent to transfer of the ejected ink; and a controller operatively connected to the applicator, the printhead, and the transfix member, the controller being configured to:

move the transfix member into engagement with the transfer member to form the nip and enable the document zone on the transfer member to pass through the nip to transfer ejected ink on the transfer member to an image receiving medium passing through the nip; and alter operation of the inkjet imaging device in response to detection of a predetermined mode of operation, the alteration of the inkjet imaging device operation being implemented by the controller, which is further configured to:

rotate the transfer member past the printhead without operating the printhead to eject ink for at least two revolutions;

move the transfix member out of engagement with the transfer member and move the applicator into engagement with the transfer member for at least one revolution of the at least two revolutions after the image receiving medium leaves the nip to remove residual ink from the transfer member;

move the transfix member into engagement with the transfer member to form the nip for at least one other revolution of the at least two revolutions to disperse ink remaining on the transfer member; and move at least one more image receiving medium into the nip to receive the dispersed ink from the transfer member before enabling the controller to operate the printhead to eject ink onto the transfer member.

7. The inkjet imaging device of claim 6, the predetermined mode of operation being a secure mode of operation.

8. The inkjet imaging device of claim 7 further comprising:

an interface configured to generate a secure mode signal and the inkjet imaging device operating in the secure mode of operation in response to the interface generating the secure mode signal.

9. The inkjet imaging device of claim 6 further comprising:

a wiping member associated with the transfer member and configured to wipe release agent from the document zone on the transfer member; and the controller being further configured to move the wiping member into engagement with the transfer member during the at least one revolution of the at least two revolutions to remove release agent and residual ink from the transfer member.

10. The inkjet imaging device of claim 9, the controller being further configured to move the wiping member out of engagement with the transfer member while the transfix member is in engagement with the transfer member during the at least one other revolution of the at least two revolutions.

* * * * *